US005890323A

United States Patent [19]

Errato

[11] Patent Number: 5,890,323

[45] Date of Patent: Apr. 6, 1999

[54] THEATER

[76] Inventor: Robert M. Errato, 44 Mountain Rd., North Haven, Conn. 06473

[21] Appl. No.: 886,680

[22] Filed: Jul. 1, 1997

[51] Int. Cl.[6] ..... E04H 3/10

[52] U.S. Cl. ..... 52/6; 52/8; 52/79.1; 52/79.4; 52/243.1; 52/238.1; 160/196.1; 160/194; 160/200; 181/30; 49/125; 49/127

[58] Field of Search ..... 52/6, 8, 79.1, 79.4, 52/243.1, 238.1, 144, 145; 181/30; 160/196.1, 194, 200, 201, 205, 210; 49/125, 127–130; D25/58

[56] References Cited

U.S. PATENT DOCUMENTS

| | | | |
|---|---|---|---|
| 469,472 | 2/1892 | Hammerstein . | |
| 663,950 | 12/1900 | Williams . | |
| 2,614,626 | 10/1952 | Garcia . | |
| 3,295,257 | 1/1967 | Douglass . | |
| 3,545,143 | 12/1970 | Bankston . | |
| 3,668,810 | 6/1972 | Bankston . | |
| 4,686,799 | 8/1987 | Kwake . | |
| 5,163,494 | 11/1992 | Mac Neil et al. | 160/201 |
| 5,406,761 | 4/1995 | Hobbiebrunken et al. | 52/243.1 |
| 5,471,791 | 12/1995 | Keller . | |
| 5,544,462 | 8/1996 | Kordes | 52/243.1 |
| 5,548,926 | 8/1996 | Sjoholm | 49/127 |
| 5,611,174 | 3/1997 | Hayashi . | |

*Primary Examiner*—Christopher Kent
*Assistant Examiner*—Yvonne Horton-Richardson
*Attorney, Agent, or Firm*—Bachman & LaPointe, P.C.

[57] ABSTRACT

The present invention relates to the design of a modern theater for providing live entertainment performances. The theater comprises an auditorium which is defined in part by a modular central core which encloses a defined space. The theater further comprises a modular stage and a two-tier balcony module. The central core module, the stage and the balcony module are each supported by independent foundations and load bearing columns. The balcony module includes an upper level with open seating and a lower level with enclosed suites. The suites are designed so as not to adversely affect the acoustics of the theater. The theater also has two side wing modules for increasing the seating capacity of the theater and other modular structures abutting the central core module. The theater also includes partitions for closing part of the side wing modules and a novel jack system for supporting the acoustic panels forming the partitions when the panels are in their extended position.

10 Claims, 12 Drawing Sheets

THEATER

CROSS REFERENCE TO RELATED APPLICATION

This application is related to co-pending U.S. patent application Ser. No. 08/885,079, filed Jun. 30, 1997, entitled THEATER.

BACKGROUND OF THE INVENTION

The present invention relates to a uniquely constructed theater for providing live entertainment performances.

Theaters for presenting live entertainment performances have existed for centuries. Typical Broadway-type theaters have an orchestra section with rows of open seats and one or more balconies with rows of open seats, all facing a stage. Concert halls and auditoriums have similar multi-level constructions. The cost of building such conventional theaters can be quite expensive since the construction techniques employed therein do not lend themselves to any cost savings. Thus, there is a need for construction techniques which allow a theater owner to construct a modern theater at lower cost.

Many theaters suffer from a fixed seating capacity which can not be altered for different types of performances. The presence of a large number of empty seats can affect the mood of the theater patrons as well as the acoustics during a performance. Thus, there is also a need for a theater design whose seating capacity can be reduced or increased for different types of performances without causing any adverse acoustical effects and while maintaining a pleasant environment for theater patrons.

Still further, there is a need for theater owners to find ways to enhance performance revenues. While corporate suites are known entities in athletic stadiums and arenas, they are unknown entities in theaters for presenting live entertainment performances such as orchestra concerts, ballets, dance performances, comedy performances, Broadway-type shows, and other forms of entertainment. It is believed that no theater had such corporate suites prior to the theater of the present invention.

SUMMARY OF THE INVENTION

Accordingly, it is an object of the present invention to provide a theater for providing live entertainment performances which utilizes modular construction techniques to reduce the cost of fabricating same.

It is a further object of the present invention to provide a theater as above which has a variable seating capacity.

It is yet a further object of the present invention to provide a theater as above which contains suites for entertaining patrons prior to, during, and after a performance.

It is still a further object of the present invention to provide a theater which lends itself to a wide variety of performances including, but not limited to, orchestra concerts, ballet, dance recitals, rock 'n roll concerts, Broadway-type shows, opera, and comedy performances.

The foregoing objects are attained by the theater of the present invention.

In accordance with the present invention, a modern theater for providing live entertainment performances comprises an auditorium having a substantially square, modular central core which encloses a defined space. The theater further comprises a two-tier balcony module within the central core module and stage and stage tower modules abutting the central core module. The central core module, the balcony module and the stage and the stage tower modules are each supported by independent structural means. In other words, each of these structures/modules is supported by its own load-bearing columns and its own foundation. By providing these independent structural means, one is able to realize a substantial cost savings and the central core module may be fabricated as a metal building. Further, one is better able to customize a theater to create a desired effect.

The modular central core has a concrete floor extending from the stage to a rear wall of the auditorium and extending across the width of the central core module, a pitched roof which extends above the floor, and partial side walls which extend down from the roof to mating structures. Acoustic ceiling tiles are suspended from the roof of the central core module to provide an acoustically desirable building.

The balcony module includes an upper level with open seating and a lower level with a plurality of enclosed suites and open seating. The suites are designed to provide select patrons with a comfortable environment in which to view performances as well as to entertain friends, customers, clients, and the like. The suites have inwardly angled windows and doors angled relative to the stage so as to not adversely affect the acoustics of the theater.

The theater also has two side wing modules abutting the central core module which side wing modules further define the auditorium. The side wing modules contain additional seating which may be utilized during performances. When the additional seating present in the side wing modules is not needed, it may be partitioned off by walls made from lightweight acoustical panels which travel along rails suspended from the roof of the theater. When the acoustical panels are in their extended position, a jack system is used to lift the weight of at least some, preferably all, of the panels from the rails and support the panel weight by contacting the floor of the theater.

The theater further includes two additional building modules abutting the central core module and the side wing modules. The two additional building modules contain staircases and elevators for accessing the balcony and the suites.

Yet another building module abuts the stage and the stage tower modules. This building module houses dressing rooms for performers and other facilities such as restrooms, catering facilities, and lounges.

Still further, the theater includes a lobby abutting the rear wall of the central core module. The lobby contains concessions stands and toilet facilities as well as entrances/exits to the auditorium. Adjacent one end of the lobby are additional building structures for housing offices and ticket windows.

Other details of the theater of the present invention, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
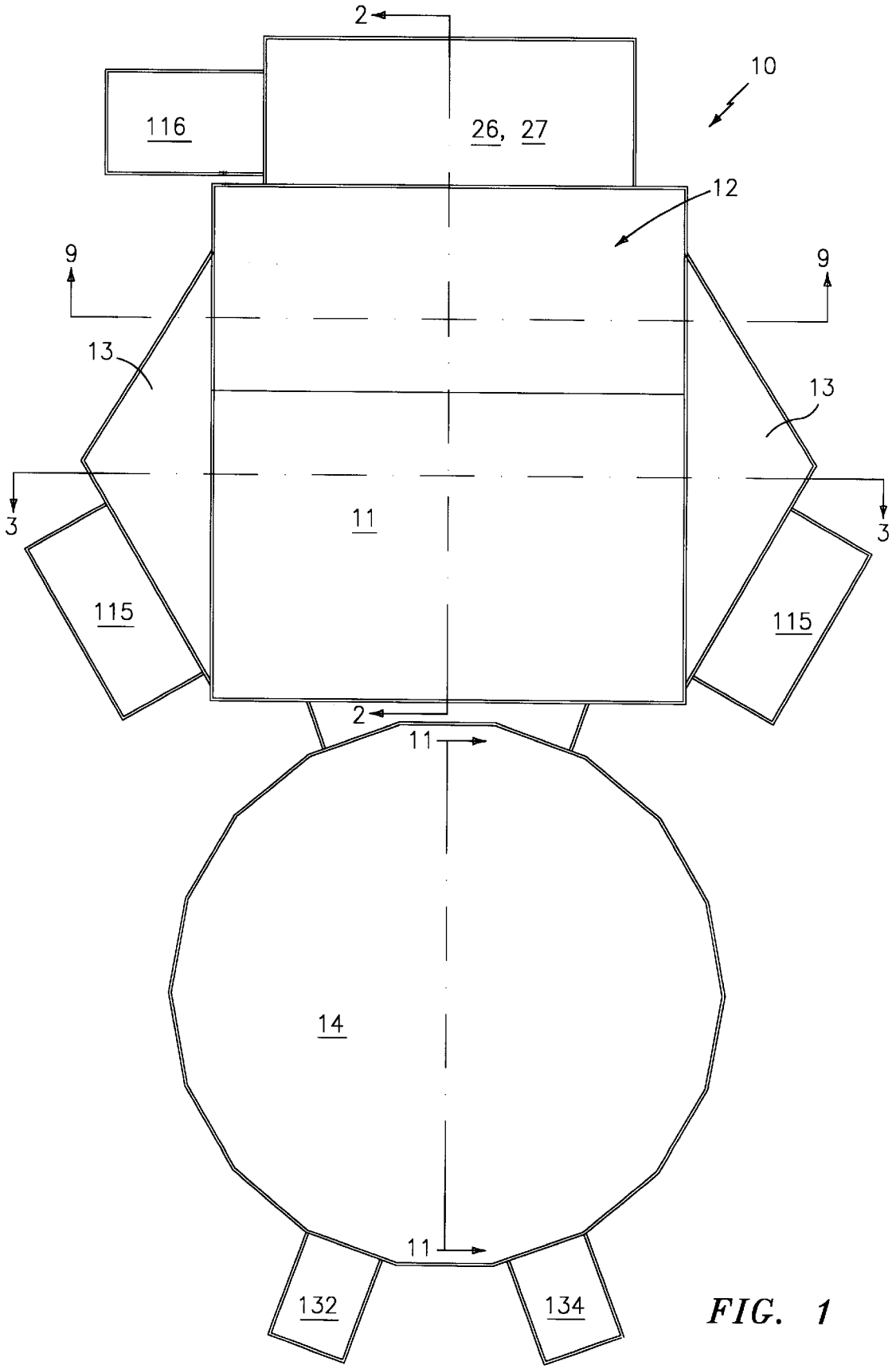
FIG. 1 is an overhead view of the theater of the present invention showing the various modules.

Referring now to the drawings, FIG. 1 illustrates the modular theater complex 10 of the present invention. As shown therein, the theater complex 10 includes an auditorium 12 defined by a central core module 11 and two side wing modules 13, a dome-shaped, multi-functional lobby 14, a dressing room module 116, side buildings 115 for housing stairs and elevators, and office/ticket window buildings 132 and 134.

Figure 2:
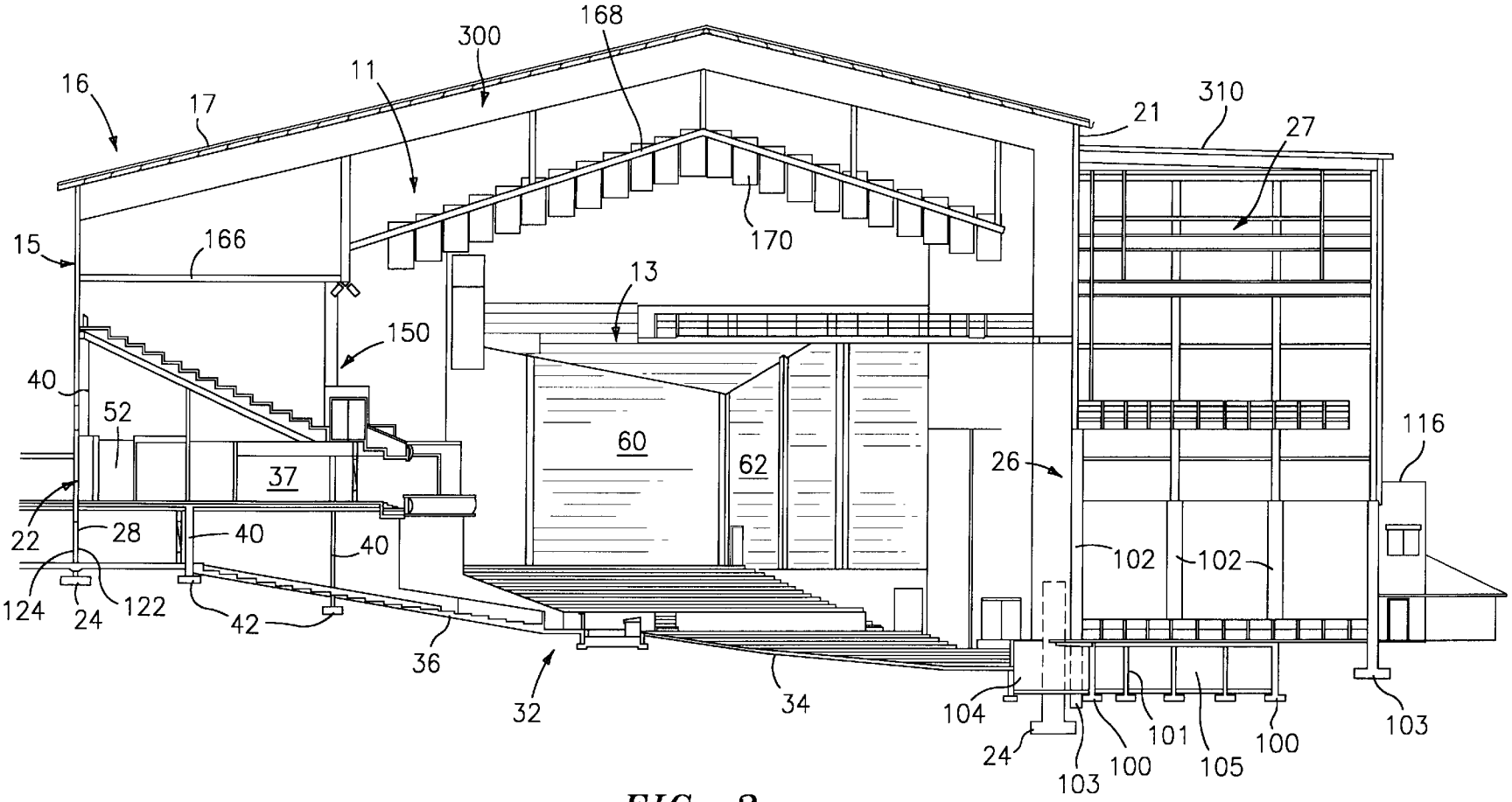
FIG. 2 is a sectional view of the auditorium portion of the theater of FIG. 1 taken along line 2—2.
Figure 3:
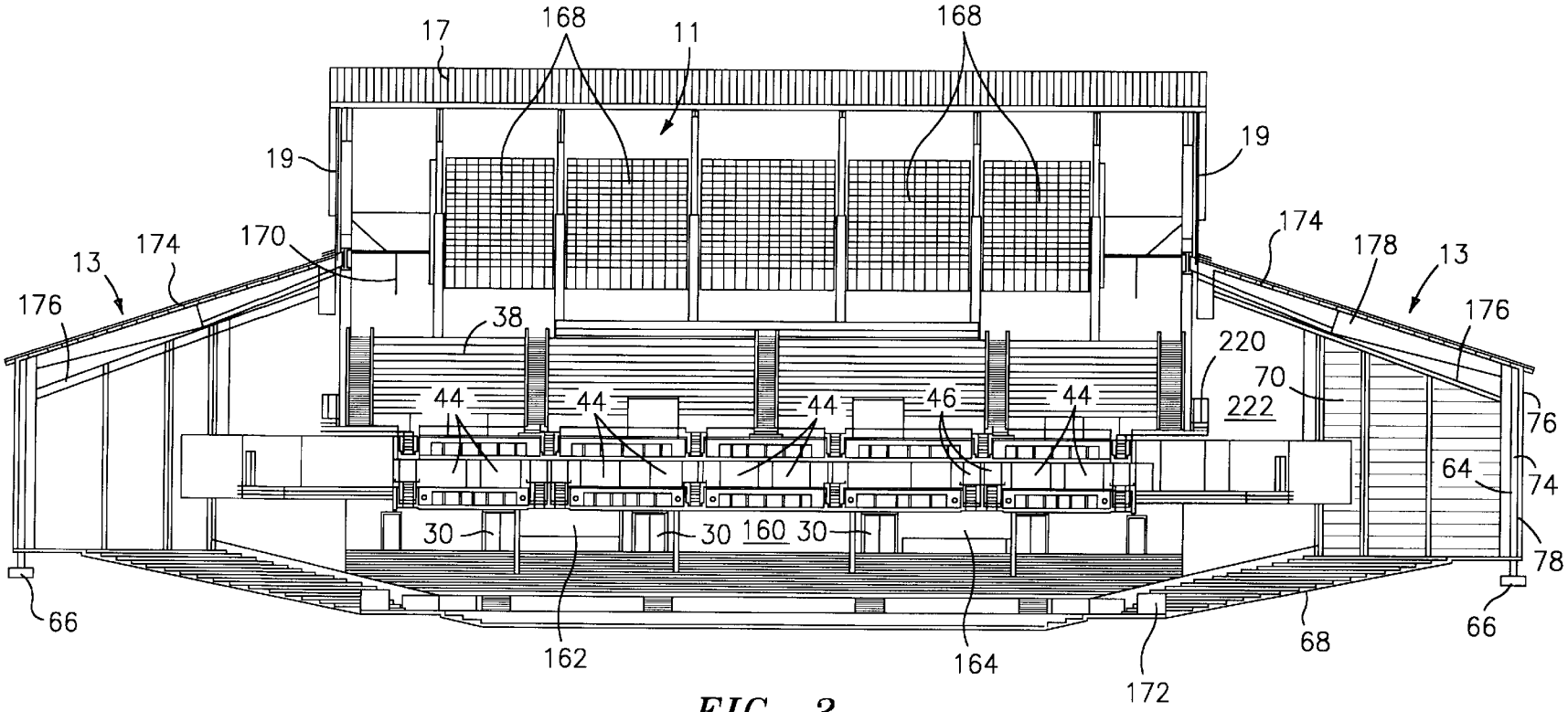
FIG. 3 is a sectional view of the auditorium portion of the theater of FIG. 1 taken along line 3—3.

As shown in FIGS. 2 and 3, the auditorium 12 is formed by a substantially square shaped central core module 11 and two substantially triangularly shaped side wing modules 13. Adjacent one end of the central core module 11 is a stage module 26 and a stage tower module 27. At the opposite end is a rear wall 28 having doors 30 through which patrons may enter the auditorium or exit to the lobby 14. The central core module 11 has an exterior shell 16 which defines a space for housing a balcony module 150, a floor 32 containing seating for the theater patrons, and various other pieces of equipment and structures needed to present live entertainment performances.

The central core module 10 has an exterior shell 16 including a rear wall 15 which extends above the lobby 14 and which preferably is a continuation of wall 28. The shell 16 further includes a roof 17, side walls 19 and end wall 21 which depend downwardly from the roof 17 until they mate with abutting structures which will be described hereinafter. The rear wall 15, the roof 17, and the side walls 19 and 21 form a part of the exterior surface of the theater. Preferably, each has aesthetically pleasing exterior siding 18, such as lightweight metal panels, secured to a structural frame 20 which will be described hereinafter. The use of lightweight metal panels for the theater exterior is highly desirable from the standpoint of presenting an aesthetically pleasing, low cost, low structural weight building which lends itself to many potential configurations. The use of these panels is possible because the various modules in the theater complex are independently supported by their own columns and their own foundations. While it is preferred to use metal panels for the siding 18, it is possible to form the exterior shell 16 from other materials.

The structural frame 20 for supporting the shell 16 includes a plurality of load bearing columns 22 spaced around the periphery of the central core module 11 and a central core module foundation 24. The foundation 24 may be formed using standard construction techniques. For example, the foundation 24 may be a poured concrete foundation. As shown in FIG. 2, the foundation 24 is level about the periphery of the central core module 11. The load bearing columns 22 may be joined to the foundation 24 using any suitable technique known in the art. The load bearing columns 22 may comprise reinforced concrete pillars which extend any desired length, for example from the foundation 24 to the top of the wall 15.

Figure 4:
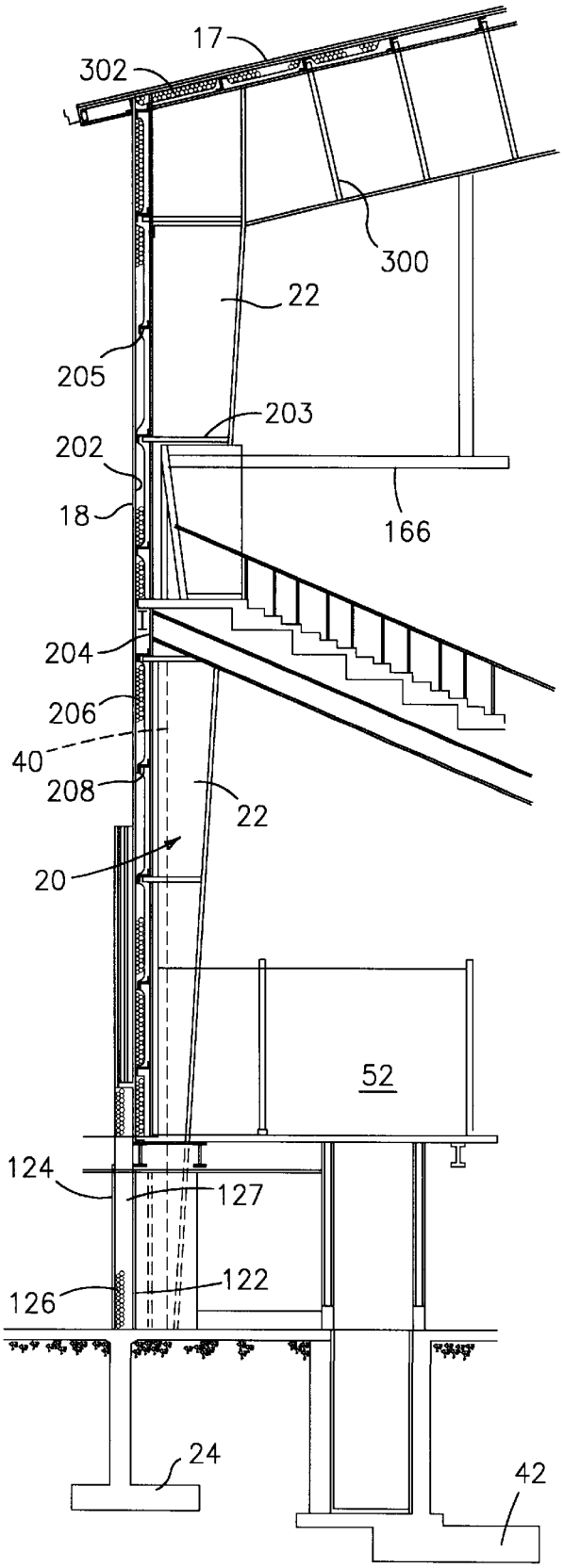
FIG. 4 is an enlarged sectional view of the rear wall and the roof of the central core portion.

FIG. 4 illustrates the construction of the rear wall 15. As shown therein, a frame 20 is formed by load bearing columns 22, horizontal bracing 203, and Z-shaped members 205. The bracing 203 and the members 205 may be secured to the columns 22 in any desired manner. The siding 18 forming the exterior portion of the shell 16 is joined to the frame 20. Any suitable means known in the art may be used to secure the siding 18 to the frame 20.

As shown in FIG. 4, the siding 18 preferably has a thermal insulation and vapor barrier 202 applied to its interior surface. The wall 15 further includes an interior surface 204 formed from drywall joined to the frame 20. The gap between the siding 18 and the interior wall 204 is partially filled with an insulating material 206 which provides soundproofing and acoustical treatment to the theater.

The sidewalls 19 and 21 are each preferably constructed in a manner similar to that of rear wall 15. Each may include an exterior metal panel, an interior wall surface, insulating material and an air gap between the interior wall surface and the metal panel. The roof 17 is formed from exterior metal panels and an open grid structure 300. If desired, the metal panels forming the roof 17 may have insulation 302 affixed adjacent their interior surfaces. The open grid structure 300 may comprise any suitable construction of supporting members including structural members (not shown) which span the width of the central core module 11.

Figure 5:
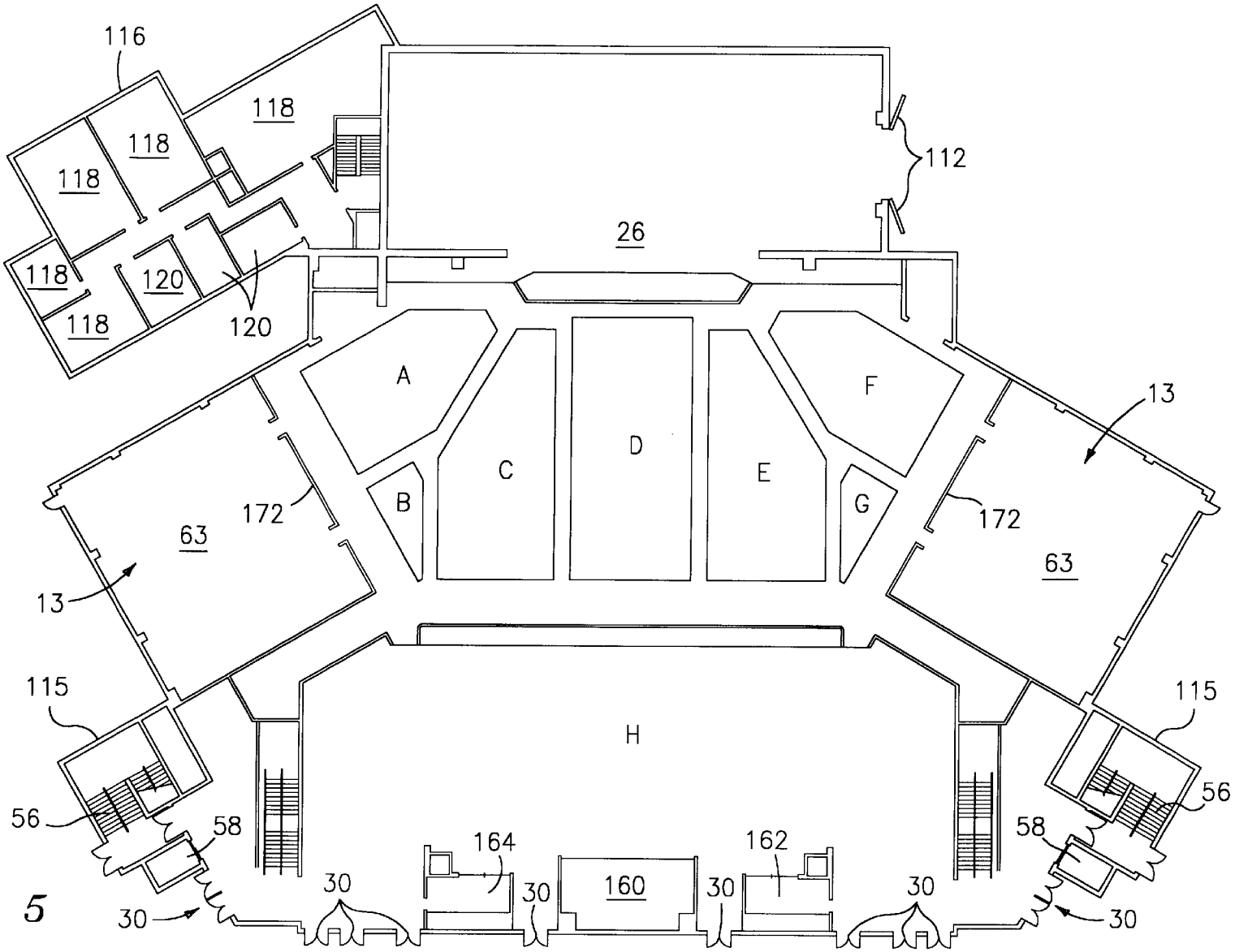
FIG. 5 is a sectional view of a portion of the theater of the present invention.

As shown in FIG. 2, the central core module 11 includes a floor 32 which defines at least part of the orchestra seating portion of the auditorium. The floor 32 extends from the stage 26 to the rear wall 28 and spans the width of the central core module 11. The floor 32 has a first inclined, substantially planar section 34 which forms the front orchestra section of the auditorium. The floor 32 also has a tiered section 36 which forms the rear orchestra section of the auditorium. Both the planar section 34 and the tiered section 36 are preferably formed from poured concrete and are later covered by aesthetically pleasing carpeting or other floor decoration (not shown). Rows of seats may be joined to the floor 32 in any desired pattern. FIG. 5 illustrates one such pattern. See Sections A–H in FIG. 5.

The rear wall 28 of the auditorium separates the central core module 11 from the lobby 14. The wall 28 includes an interior wall 122 formed from a material, such as drywall, and a wall 124 which forms the rear wall of the lobby 14. The wall 124 may also be formed from drywall. In order to maintain the desired acoustical effect in the theater, the space between the walls 122 and 124 contains a soundproofing material 126, such as fiberglass insulation, and an air gap 127. If desired, a layer of fireproofing material (not shown) may also be included between the two walls 122 and 124.

Figure 6:
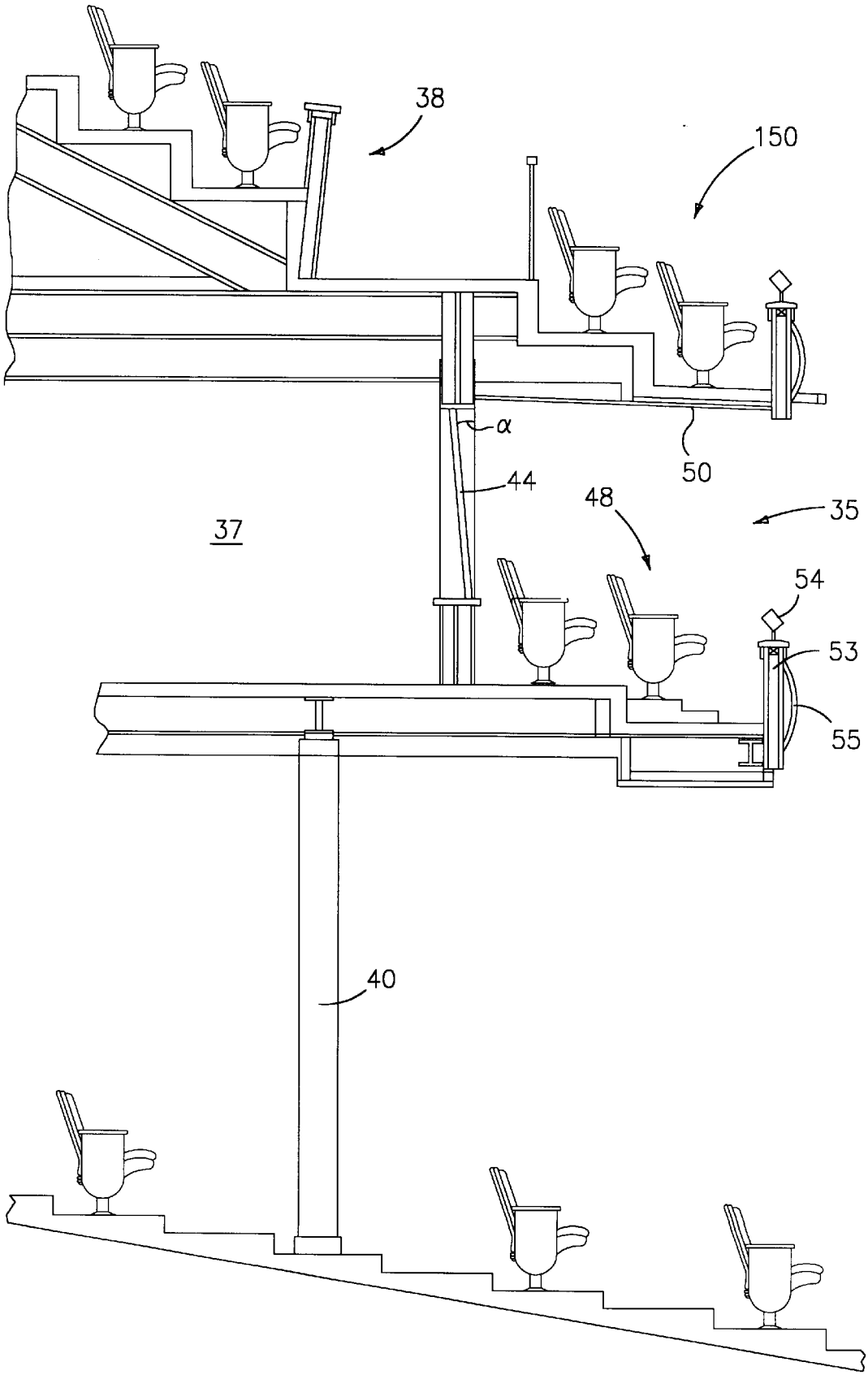
FIG. 6 is a sectional view of the balcony module including enclosed suites on one level.

Referring now to FIGS. 2 and 6, as previously discussed, a balcony module 150 is placed within the central core module 11. The balcony module 150 includes a first level 35 containing a number of enclosed and soundproofed suites 37 and a second level 38 containing rows of open seats. The balcony module 150 is structurally supported by a plurality of vertically extending load bearing columns 40 and a foundation 42. Some of the load bearing columns 40 extend from the foundation 42 to the underside of the second level 38 (see FIG. 4), while others preferably extend only to the underside of the first level 35 (see FIG. 6). The length of the individual columns 40 may be chosen as needed to support the balcony module 150 in a non-cantilevered fashion. The load bearing columns 40 and the foundation 42 may be formed from any suitable materials known in the art. For example, they can be concrete posts reinforced with steel, while the foundation 42 may be formed from poured concrete. The load bearing columns 40 may be joined to the foundation 42 in any desired manner known in the art.

The load bearing columns 40 and the foundation 42 are structurally independent of the load bearing columns 22 and the foundation 24. This is because the load bearing columns 22 and the foundation 24 are not designed to support the weight of the balcony module 150. As previously mentioned, neither level of the balcony module 150 is a cantilevered structure. In most conventional theaters, the various loge and balcony levels are cantilevered structures which impose difficult structural requirements for the load bearing columns.

The suites 37 on the first level 35 are believed to be unique to theaters presenting live entertainment performances. The design of the suites 37 takes into account the need to avoid adversely affecting the acoustics of the theater. As shown in FIG. 6, each suite 37 has a window 44 for allowing occupants of the suite to view the performance. In order to maintain the acoustical integrity of the theater, each window 44 is angled inwardly from its bottom to its top. Preferably, each window 44 is angled inwardly at an angle $\alpha$ of about 6 degrees. Additionally, each suite 37 has a door 46 for allowing occupants to access rows of open seats 48 placed in front of the suite. Again, in order to maintain the acoustic integrity of the theater, each door 46 is angled with respect to the stage 26. Further, the space above the rows of seats 48 is lined with drywall 50.

Each suite 37 includes an enclosed entertainment space which may be accessed via a rear door (not shown) and a corridor 52 along the rear of the first level 35, which corridor can be accessed by stairs and elevators in the side buildings 115 and by stairs 244 from the lobby 14. Within the enclosed entertainment space, seating for the patrons and their guests, as well as kitchen facilities, bathroom facilities, and other entertainment facilities, can be provided. Each suite 37 may be tailored to the taste of a particular patron. Additionally, each suite 37 may include closed circuit television for viewing the performance and a speaker system for listening to the performance. The suites 37 allow the theater operator to enhance the earnings of the theater since they may be rented either on an annual basis or on an event basis. They also allow select patrons to entertain guests without interfering with other patrons of the theater.

As previously discussed, there are rows of seats 48 in front of the suites 37. A wall 53 and a safety railing 54 are provided to insure the safety of the patrons occupying these seats. The wall 53 and the safety railing 54 may be formed from any material which does not adversely affect the acoustics of the theater. Typically, the wall 53 is formed by a frame and painted drywall mounted to the frame. Acoustic panels 55 are mounted to the front portion of the wall 53 to assist in maintaining the acoustical integrity of the theater. The railing 54 is preferably formed from wood. To further enhance the acoustics of the building, the railing 54 is angled so that none of its planar surfaces directly faces the front of the stage 26.

As shown in FIG. 3, the lower level of the central core module 11 may include a further suite 160 adjacent the rear wall 28. As with the suites 37, the suite 160 may be used to entertain certain patrons either prior to, during, or after a performance. Here again, the front wall of the suite 160 contains an inwardly angled window (not shown) for viewing the performance. The lower level may also contain an enclosed control room 162 for individuals operating the lights and/or sound during the performance, and a further open box 164 for accommodating handicapped patrons or for storage.

The central core module 11 is provided with a number of features to promote the acoustics of the theater. These features include grids of ceiling tiles 166 suspended over the upper level 38 of the balcony module 150 and grids of ceiling tiles 168 suspended over the central portion of the module 11. The grids of ceiling tiles 166 and 168 may be suspended in any desired manner from the open grid structure 300 supporting the roof 17. Additionally, rows of banners 170 may be suspended from the structure 300 to further absorb sound and add decoration to the theater. The banners 170 are preferably positioned outside of the outermost group of ceiling tiles 168.

As shown in FIGS. 2, 3, and 5, the auditorium 12 includes two triangularly shaped side wing modules 13 abutted against the central core module 11. The side wing modules 13 provide additional seating 63 for performances. Each module 13 has two walls 60 and 62 substantially at right angles to each other. Preferably, each of the walls 60 and 62 has a length substantially equal to one-half the length of a side of the substantially square central core module 11.

The side wing modules 13 are independent of the central core module 11 in that each has its own independent load bearing columns 64 and its own foundation 66. The side wing modules 13 each have a poured concrete floor 68 to which floor treatments such as carpeting can be applied and to which rows of seats 63 can be secured. Preferably the concrete floor 68 has a tiered construction as shown in FIG. 3. A wall 172 is provided in front of the front row of the seating in the side wing module. This wall 172 is provided to create an aesthetically pleasing appearance and to separate the front row of seats from the aisle in front of them. Still further, each side wing module 13 includes an angled roof portion 174 which mates with one of the central core module sidewalls 19.

As can best be seen from FIG. 3, the side wing modules 13 only have one level of seating. Thus, there is a substantial empty space above the seats in the side modules. In order to avoid adversely impacting the acoustics of the theater, the interior surface of the walls 60 and 62 are formed from perforated metal panels 70. The panels 70 are preferably formed from substantially horizontal lengths of perforated metal. Soundproofing, such as fiberglass insulation 74, is provided behind the panels 70. Additionally, an air gap 78 is provided between the fiberglass insulation 74 and the exterior wall 76. Still further, acoustic ceiling tiles 176 are suspended from the frame 178 supporting the roof 174. The ceiling tiles 176 may be suspended from the frame 178 using any suitable technique known in the art.

Figure 7:
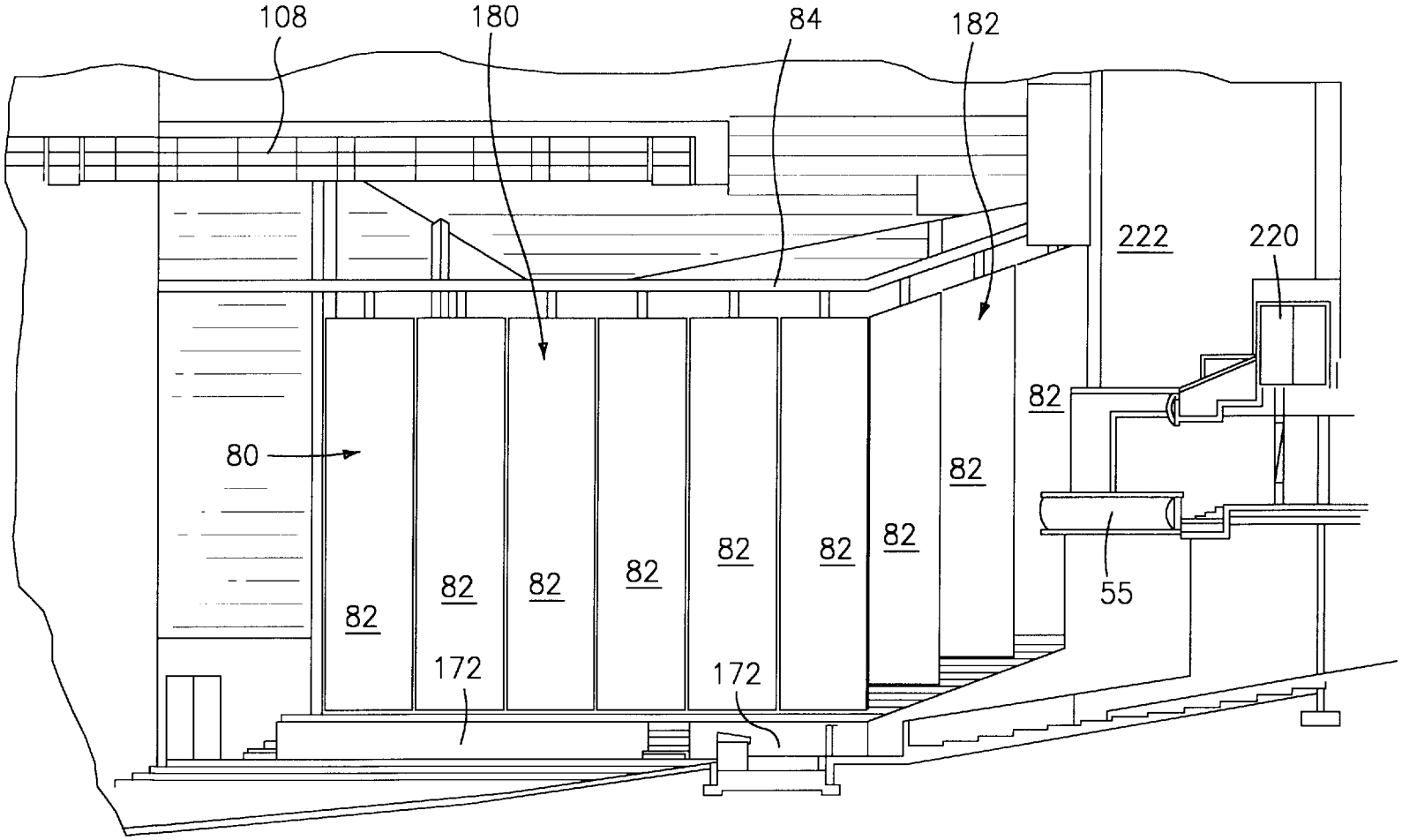
FIG. 7 is a perspective view of the partition curtains used to partition off the seating in the side wing modules.

There may be times when the seating in one or more of the side wing modules 13 is not needed for a particular performance. Partition walls 80 are provided to close off the seating in the side wings 13. Each partition wall 80 is formed by a plurality of lightweight acoustic panels 82 which travel along a rail 84 secured to the roof of the auditorium. In a stored position, a number of the panels 82 are stacked in a location adjacent the stage 26, while others of the panels are aligned along a wall adjacent the stage 26 to create an aesthetically pleasing appearance. In a deployed position, as shown in FIG. 7, the panels form two substantially planar surfaces 180 and 182. The panels 82 forming the first surface 180 all have the same length and thus create a wall-like effect. As can be seen from FIG. 7, the panels 82 forming the surface 180 substantially abut the upper edge of the wall 172. A second surface 182 is formed by a plurality of panels 82 having different lengths. These panels are provided with different lengths so as to accommodate the rise in the side wing module seating and the aisles for gaining access to the side wing module seats.

Figure 8:
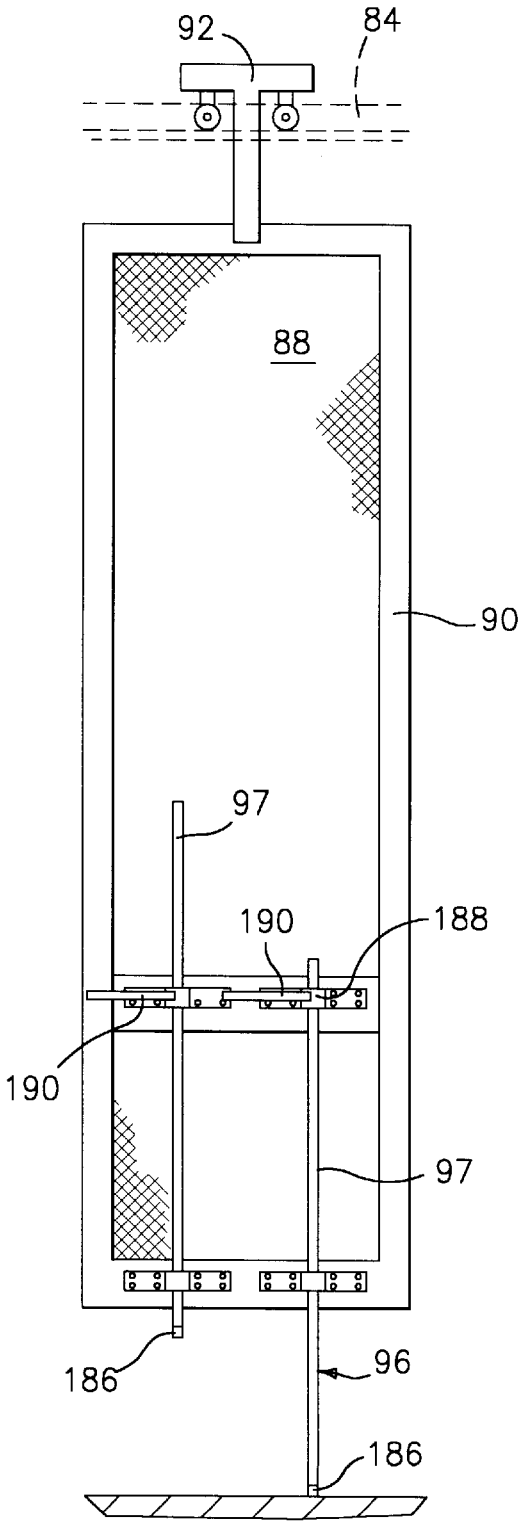
FIG. 8 is a rear view of one of the panels forming the partition curtain.

As shown in FIG. 8, each acoustic panel 82 is preferably formed by a piece of fabric 88 placed over a rectangular frame 90. The frame 90 may be formed from any suitable material known in the art. Preferably, a relatively lightweight material such as aluminum is used to form the frame 90. The fabric 88 placed over the frame may be formed from any suitable sound absorbing or acoustic material and may have any desired aesthetically pleasing appearance.

A set of rollers 92 is attached to the top of each panel 82 to allow the panel to traverse along the rail 84 from the stored position to the extended position and viceversa. When the panels 82 are in their extended position, it is necessary to reduce the weight on the rail 84. If the weight were not removed, it would not be possible to construct the central core module 11 essentially as a metal shell. To this end, two jacks 96 are mounted to the rear of each panel 82 adjacent the lower end of the panel. The jacks 96 each include an adjustable extensible length member 97, preferably formed from metal, having a floor contacting pad 186 at its lower end and a locking fixture 188 adjacent an upper end. The jacks 96 each further include a latching mechanism 190 attached to the back of the panel to engage the locking fixture 188. When used, the floor jacks 96 raise the panel 82 so that the rail 84 does not support all the weight of the panel.

Even though the side wing modules 13 are essentially freestanding structures independent of the central core module 11, they are joined to the central core module 11 so as to provide a unitary structure. Expansion joints (not shown) may be provided at the ridge line of the roof 174 to join the roof 174 to the central core module 11. The expansion joints accommodate expansion and contraction due to environmental conditions as well as join the structures together in a non-load bearing manner.

As shown in FIG. 5, two side modules 115 are positioned in an abutting relationship to the side wing modules 13 and the central core module 11. The side modules 115 house staircases 56 and elevators 58 which provide access to the suites 37 and the balcony 38. Additionally, they house corridors for gaining access to the staircases and elevators and to other portions of the auditorium. The side modules 115 are preferably concrete building structures erected on a concrete slab (not shown).

Doors 220 are used to gain access to the balcony 38. The doors 220 are preferably angled with respect to the stage 26 so as to avoid adversely affecting the acoustics in the theater. The interior surfaces 222 adjacent the doors 220 are preferably formed from drywall mounted to a frame (not shown). If desired, the interior surfaces 222 could be formed from perforated metal panels similar to those used in the side wing modules or from drywall having perforated metal panels incorporated therein. The surfaces 222 may be decorated in any desired manner.

As with the other components of the theater, the stage 26 and the stage tower 27 have their own modular constructions. As shown in FIG. 2, the stage module 26 and the stage tower module 27 sit on their own foundations 103. Each has its own load bearing columns such as columns 102 extending upwardly therefrom. Additionally, the stage floor, the orchestra pit 104 and the trap door rooms 105 are supported by foundation 100 and load bearing columns 101. As before, the foundations and the load bearing columns may be formed in any conventional manner. Preferably, the foundations are poured concrete foundations and the load bearing columns are reinforced concrete columns.

The columns 102 provide the supports for the various frames and the like needed to support the stage lighting, the stage curtain, the fire curtain and various stage walls. They also support the roof 310 which is joined to the wall 21 preferably by expansion joints (not shown). As previously discussed, the foundation 100 and the columns 101 support an orchestra pit 104 and other rooms and passageways (not shown) located beneath the stage 26.

Figure 9:
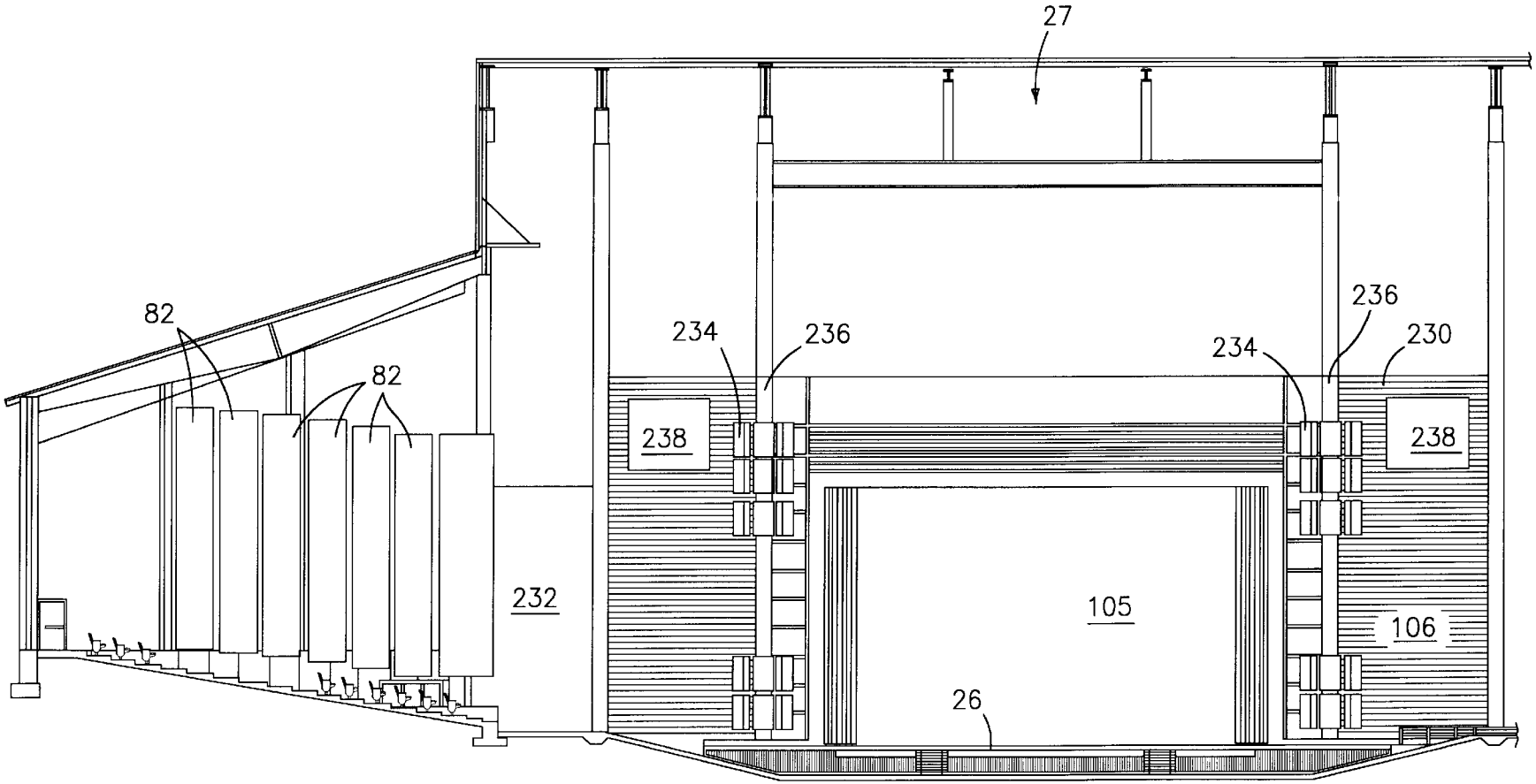
FIG. 9 is a front view of the stage of the theater.

FIG. 9 is a front view of the stage 26 and a portion of the stage tower 27. As shown therein, there is a central opening 105 surrounded by a front wall structure 106. The front wall structure 106 adjacent the opening 105 is preferably formed by a plurality of perforated metal panels 230 mounted to a frame. Front wall portions 232 away from the opening are preferably formed by drywall mounted to the frame. These portions may be decorated in any desired manner. If desired, speakers 234 may be mounted to columns 236 supporting the front wall structure 106. To enhance the performance experience for patrons of the theater, viewing screens 238 may be mounted to the front wall structure 106. In addition to enhancing the performance experience for the theater patrons, the viewing screens 238 allow the performing artists to create desired special effects.

Figure 10:
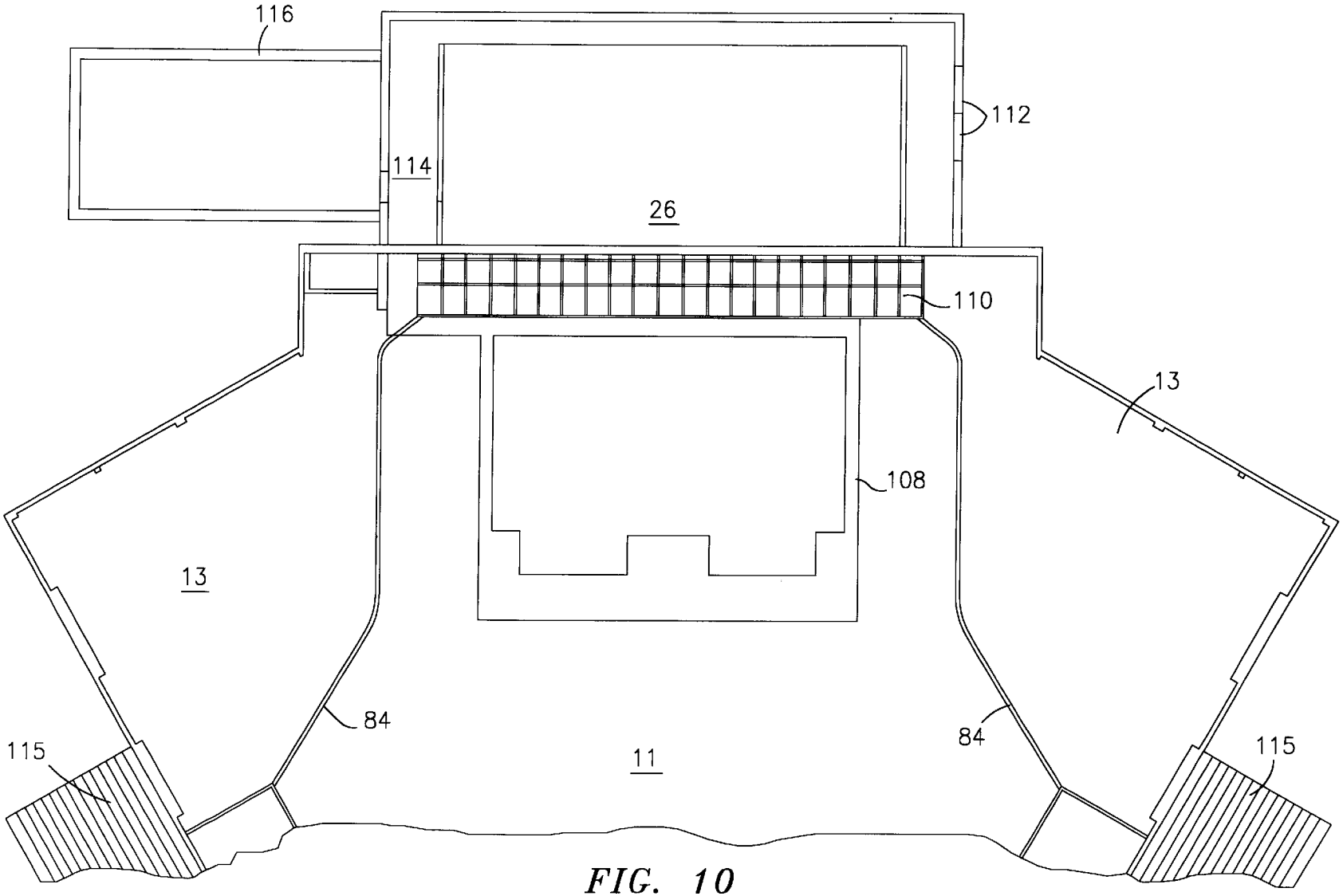
FIG. 10 is a sectional view of the theater showing the catwalk, the forestage grid, and the rails along which the partition curtains travel.

As shown in FIG. 10, a catwalk 108 and a forestage grid 110 are provided adjacent the stage 26. Preferably, both of these structures are secured to the roof of the central core module 11 and its support structure 300. Any suitable means known in the art may be used to suspend or mount these structures. The catwalk 108 may be used to mount speakers and lights which are used during a performance. The forestage grid 110 may be used to increase lighting capacity and to permit the use of special effects during the performance.

The stage module 26 is provided with loading doors 112 for receiving or removing scenery and/or other equipment. Additionally, the stage module 26 is provided with access 114 to dressing rooms and the like housed in a separate structure 116 abutting the stage module 26.

FIG. 5 illustrates the structure 116. As shown therein, this structure contains dressing rooms 118 for performers and other facilities 120 such as offices, locker rooms, electrical equipment rooms, lounges, and catering facilities. It also contains private entrances/exits 240 for the performers.

While only one level of the structure 116 has been shown, the structure may in fact have multiple levels as needed. The structure 116 preferably is supported on its own concrete foundation and may be made from any desired material. For example, the structure 116 may be a concrete structure having metal siding which matches the metal panels forming the exterior shell to the theater.

Figure 11:
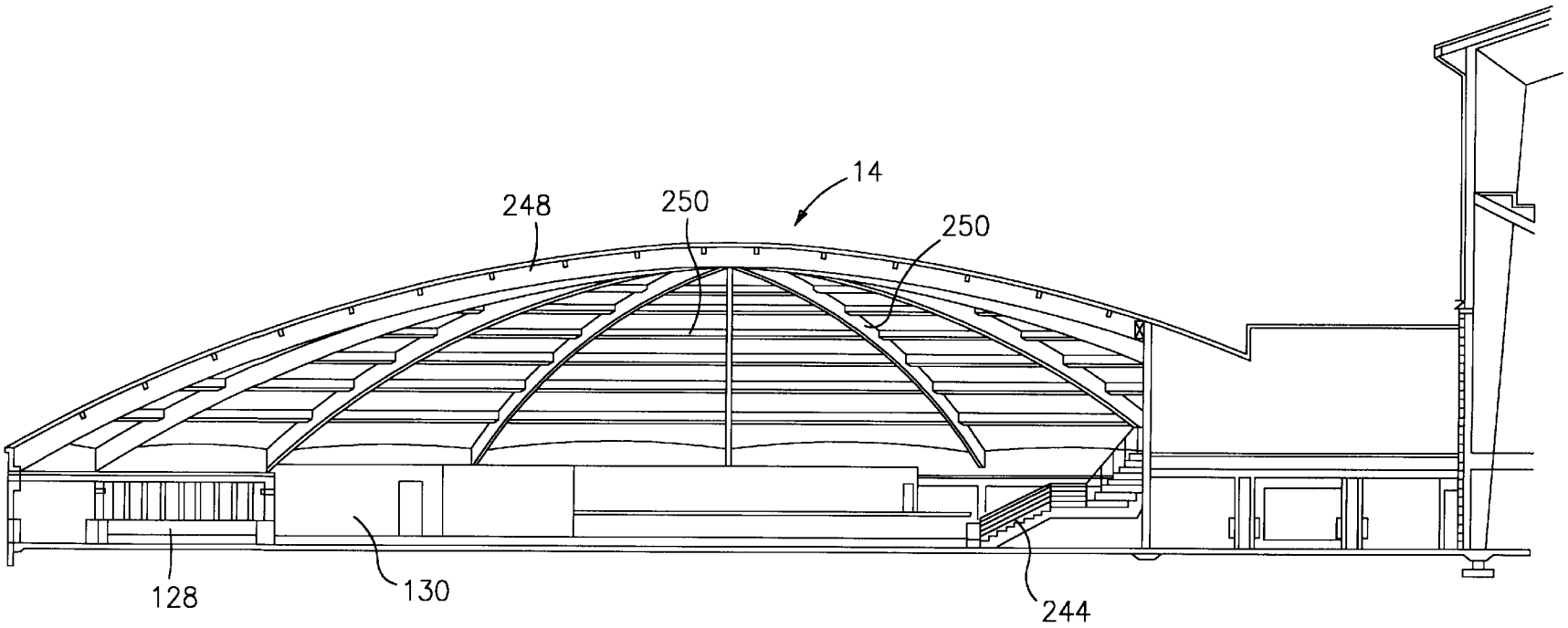
FIG. 11 is a cross sectional view of the lobby module taken along line 11—11.
Figure 12:
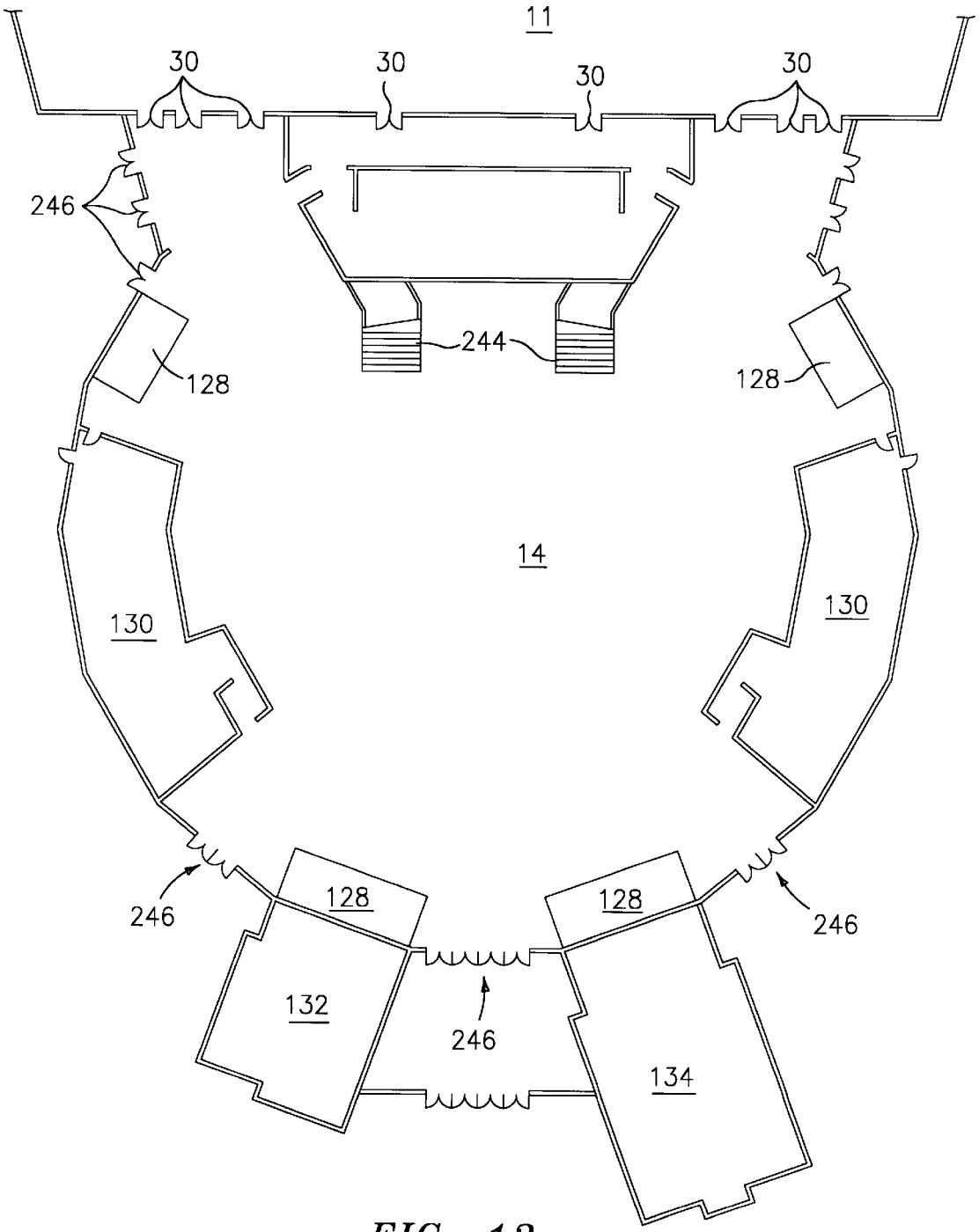
FIG. 12 is a sectional view of the lobby.

Referring now to FIGS. 11 and 12, a lobby module 14 is located adjacent one end of the central core module 11. The lobby 14 serves a variety of different purposes. First, it provides access to the auditorium 12 via doors 30. Additionally, the lobby 14 houses food and drink concessions 128 and toilet facilities 130. It further contains staircases 244 which lead to the upper levels of the auditorium 12 such as the corridor outside the suites 37. If desired, the lobby 14 may be provided with fixed or movable tables (not shown) for patrons to use during preperformance periods and intermissions. The lobby module 14 may have any desired exterior shape. For example, it may have a substantially round periphery to allow access through an increased number of doors 246. It may also have a dome shaped roof 248 so as to provide an airy feeling to the lobby. If desired, the dome shaped roof 248 could have exposed wooden interior supports 250 to create a pleasant aesthetic effect.

The lobby module 14 may also be used to provide entertainment outside of the auditorium 12. For example, a portable stage (not shown) could be erected in the lobby for speakers and/or performers. Additionally, television screens (not shown) could be mounted to the walls of the lobby to provide entertainment for patrons.

As shown in FIG. 12, additional building structures 132 and 134 can be provided to house offices and ticket windows. The building structures 132 and 134 may be erected using any suitable construction technique and any suitable material. For example, each structure could be a concrete building having metal or brick exterior surfaces. As with all the other structures making up the theater, each of the structures 132 and 134 is supported on its own foundation, preferably a concrete slab.

As can be seen from the foregoing description, the theater of the present invention is formed by a plurality of independently supported modules. Because of this modular construction, the cost of building the theater of the present invention is substantially less than the cost of building other types of theaters. In fact, cost savings of several million dollars can be realized.

The theater of the present invention provides still other advantages. For example, it allows the theater owner to vary the seating capacity of the theater depending on the type of performance to take place. It also allows the theater owner to increase revenues by providing suites for patrons to entertain friends, customers, clients and the like.

It is apparent that there has been provided in accordance with the present invention an entertainment theater which fully satisfies the objects, means and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A theater for presenting live entertainment performances, said theater comprising:

a central core module including seating for people viewing said performances;

two side modules abutting said central core module;

each of said side modules having additional seating for people viewing said performances; and means for partitioning off said seats in said side modules, said partitioning means comprising a plurality of acoustic panels movable along a track from a stored position to an extended position where at least some of said panels form a first wall positioned in front of at least some of said seats and others of said panels form a second wall at an angle to said first wall.

2. The theater of claim 1 wherein said panels forming said first wall all have the same length.

3. The theater of claim 1 wherein said panels forming said second walls all have different lengths so as to accommodate the rise of said seats.

4. The theater of claim 1 wherein each of said panels has a jack system attached to it for allowing the weight of said panels to be removed from said track when said panels are in said extended position.

5. The theater of claim 1 wherein said track is attached to the roof of the theater.

6. A partition for separating two sections of a static structure, said partition comprising:

a plurality of panels;

a track along which said panels move between a stored position and an extended position; and means for removing the weight of said panels from said track when said panels are in said extended position.

7. The partition of claim 6 wherein said weight removing means comprises at least one jack mounted to each panel.

8. The partition of claim 7 wherein each said jack comprises an extensible member having a lower end for contacting a support structure and means for securing said extensible member in a retracted position where said end is out of contact with said support structure and for securing said extensible member in an extended position where said end contacts said support structure.

9. The partition of claim 6 wherein each panel comprises an acoustic panel.

10. The partition of claim 6 wherein each said panel comprises a frame and a sound absorbing material secured to said frame.

* * * * *